United States Patent [19]

Niskanen

[11] Patent Number: 4,921,400

[45] Date of Patent: May 1, 1990

[54] PUMP AND A METHOD OF SEPARATING GAS BY SUCH FROM A FLUID TO BE PUMPED

[75] Inventor: Toivo Niskanen, Hamina, Finland

[73] Assignee: A. Ahlstrom Corporation, Noormarkku, Finland

[21] Appl. No.: 216,009

[22] Filed: Jul. 6, 1988

[30] Foreign Application Priority Data

Jul. 6, 1987 [FI] Finland ..... 872967

[51] Int. Cl.[5] ..... F04D 29/70

[52] U.S. Cl. ..... 415/169.1; 55/52

[58] Field of Search ..... 210/416.1, 928; 55/52, 55/199; 415/169.1, 171.1

[56] References Cited

U.S. PATENT DOCUMENTS

| | | | |
|---|---|---|---|
| 1,345,895 | 7/1920 | Seguin | 55/201 |
| 3,230,890 | 1/1966 | Yokota et al. | 415/116 |
| 3,435,771 | 4/1969 | Riple | 415/123 |
| 3,944,406 | 3/1976 | Jagusch et al. | 55/407 |
| 4,084,946 | 4/1978 | Burgess | 55/199 |
| 4,194,893 | 3/1980 | Woodhouse et al. | 55/168 |
| 4,414,006 | 11/1983 | Armstrong | 55/190 |
| 4,435,193 | 3/1984 | Gullichsen et al. | 55/190 |
| 4,776,758 | 10/1988 | Gullichsen | 415/168 |

FOREIGN PATENT DOCUMENTS

| | | |
|---|---|---|
| 858357 | 12/1952 | Fed. Rep. of Germany . |
| 862563 | 1/1953 | Fed. Rep. of Germany . |
| 864953 | 1/1953 | Fed. Rep. of Germany . |
| 948213 | 8/1956 | Fed. Rep. of Germany . |
| 1023671 | 1/1958 | Fed. Rep. of Germany . |
| 2312022 | 9/1973 | Fed. Rep. of Germany . |
| 456863 | 6/1913 | France . |

*Primary Examiner*—Robert E. Garrett
*Assistant Examiner*—John T. Kwon
*Attorney, Agent, or Firm*—Cohen, Pontani & Lieberman

[57] ABSTRACT

A centrifugal pump and a method of separating gas from a gas containing liquid-solids suspension. The method and apparatus of the invention is especially suitable for pumping of fiber suspensions in the pump and paper industry. The pump includes a suspension chamber having a suspension inlet and a suspension outlet, a gas chamber in fluid communication with the suspension chamber and a perforated surface located between the suspension chamber and the gas chamber for substantially preventing the solids from passing into the gas chamber.

43 Claims, 2 Drawing Sheets

PUMP AND A METHOD OF SEPARATING GAS BY SUCH FROM A FLUID TO BE PUMPED

FIELD OF THE INVENTION

The present invention relates to a pump and a method of separating gas from a gas containing liquid-solids suspension to be pumped. More specifically, the invention relates to a gas discharge system of a pump used for pumping fiber suspensions of the pulp and paper industry.

BACKGROUND OF THE INVENTION

It is known that pumping of fluids containing gases, with higher gas contents, is unsuccessful without a gas discharge system because the gas concentrates around the center of the pump rotor, forming a bubble which grows thus tending to clog the entire inlet opening of the pump. This results in a considerable decrease of the output, increased vibration of the equipment, and in the worst case, malfunctioning of the pump. This problem has been experienced in a very severe form with, for example, centrifugal pumps.

These problems have been attempted to be solved in many different ways by discharging the gas bubble from the pump. In the equipment presently known and used, degasification is effected by either drawing gas through a pipe being disposed in the middle of the inlet opening of the pump and extending to the hub of the impeller, by drawing gas through a hollow shaft of the impeller, or by providing the impeller with one or more perforations through which the gas is drawn to the back side of the impeller and away.

The known solutions function satisfactorily if the fluid is neat or pure. Problems, however, arise when the fluid contains foreign matter such as fibers, threads and the like. In such a case, the contaminants tend to clog the gas discharge duct of the pump, the staying open of which is a matter of necessity for the proper operation of the pump. Several different arrangements are known by means of which it has been tried to eliminate or minimize the disadvantages or risks caused by contaminants. The simplest arrangement is a gas discharge duct which is so wide that clogging will not occur. Other methods used are, for example, arrangements with various types of vanes or vaned rotors on the back side of the impeller. A commonly used method has been to provide the immediate back surface of the impeller with radial vanes which are intended for pumping the gas containing suspension with its contaminants so that the suspension with the gas entrained therein is directed through the gas discharge openings of the impeller to the outer periphery of the impeller and through its clearance back to the liquid flow. In some cases, a similar type arrangement has been provided on the back side of the impeller by means of a vaned rotor mounted on the shaft of the impeller. Said vaned rotor rotates in a separate chamber thereby separating the liquid which has been carried with the gas to the outer periphery of the chamber, while the gas can be further drawn to the inner periphery. The liquid accumulated on the outer periphery of the chamber is directed, together with the contaminants contained therein, through a separate duct to either the inlet side or the outlet side of the pump.

All of the above described devices operate satisfactorily if the amount of contaminants or foreign matter being carried with the liquid is limited. It is also possible to adjust the devices to operate relatively reliably with liquids that contain greater amounts of solids, e.g. with fiber suspensions in the pulp industry. In that case, however, a compromise must be reached between pumping a suspension having solids content and the necessity of discharging gas because it is of utmost importance to ensure that no fibers are conveyed to the gas discharge duct of the pump. Thus, a fiber suspension containing gas is returned back to the flow. On the other hand, it is known that the gas contained in the fiber suspension is undesired in the stock preparation process and should be avoided as far as possible. Therefore, existing advantages of these known pumps are wasted by feeding the gas that has already been separated back to the stock circulation. It is also wasting of stock if, on the other hand, all stock conveyed along with the gas were separated from the stock circulation by discharging the stock as a secondary flow of the pump.

SUMMARY OF THE INVENTION

One object of the invention is to provide a centrifugal pump for separating gas from liquid without risk of foreign matter, i.e. solids such as wires, fibers and the like contained in the liquid, clogging the gas discharge ducts of the pump. The apparatus according to the invention is characterized in that the gas discharge passage from the front side of the impeller to the gas discharge duct is provided with one or more perforated surfaces such as a filter surface or the like for separating the gas from the solids containing liquid to be pumped.

The method according to the invention is characterized in that, while the liquid is being pumped, the flow of both, the separated gas and other material being entrained in the liquid, is directed to the separation means where solids are separated from said flow, whereby it is possible to separately discharge the gas.

Advantages of the centrifugal pump according to the invention over existing devices are, for example, the following:

more efficient gas discharge because the liquid containing gas need not be returned to the main circulation;

pumping of fiber suspensions involves no risk of the gas discharge ducts becoming clogged or the fiber suspension being wasted or being led to waste waters;

furthermore, there is no risk that the pressure of the pumped material would force contaminants into the gas discharge ducts when the pump is in a stand-still, a frequent problem encountered with equipment containing conventional gas discharge devices.

BRIEF DESCRIPTION OF THE DRAWINGS

The apparatus of the invention is further described in greater detail with reference to the accompanying drawings, in which.

DESCRIPTION OF THE PRESENTLY PREFERRED EMBODIMENTS

Figure 1:
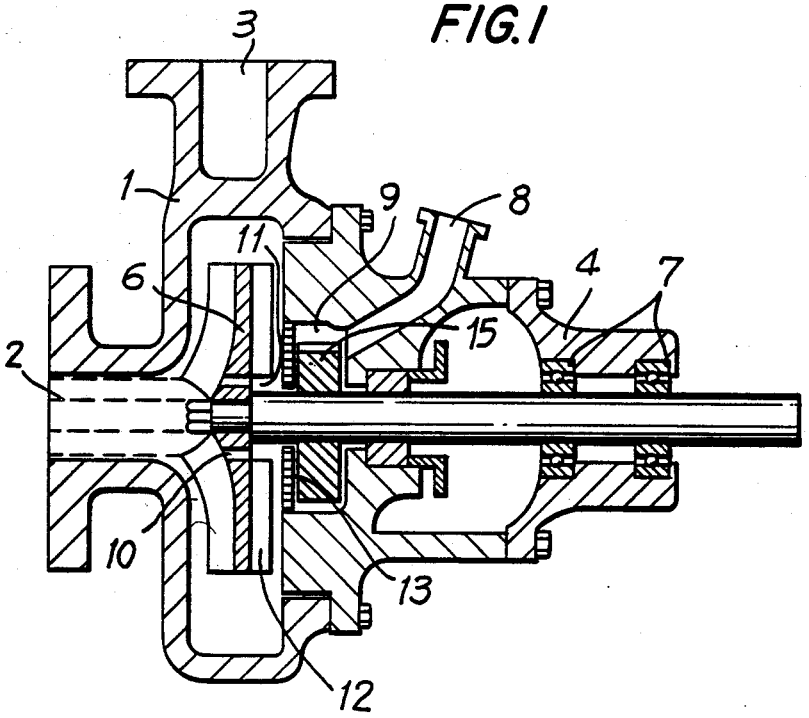
FIG. 1 illustrates a centrifugal pump according to the present invention.

FIG. 1 illustrates a conventional centrifugal pump comprising a casing 1 defining a suspension chamber with a suspension inlet opening 2 and a suspension outlet opening 3, a body 4 housing a gas chamber 9, and a shaft 5 with an impeller 6. The shaft 5 is mounted on bearings 7 disposed within the body 4, which is also provided with a gas discharge duct 8 originating from the chamber 9 which surrounds the shaft 5. The gas chamber 9 is in fluid communication with the impeller 6, which is provided with one or more openings 10 for leading gas from the front side of the impeller to the back side thereof to a space 11. The back surface of the impeller 6 is provided with vanes 12, which preferably are arranged radially but which may also be curved or be disposed on a plane not extending through the shaft, as will be described later.

As shown in FIG. 1, wall 13 is disposed between the gas chamber 9 and the space 11. Wall 13 is formed of a screen plate provided with a plurality of small holes or slots intended to prevent the foreign matter contained in the liquid treated by the pump from entering the gas discharge duct 8. When a centrifugal pump is used for pumping pulp suspensions in the pulp industry, the perforation diameter or the slot width of the screen plate is preferably very small. Tests have indicated that the above-mentioned dimensions are preferably approximately about 0.2 mm in order to prevent substantial penetration of the fibers of the pulp suspension into the screen plate. In such a construction, however, the vanes 12 of the impeller 6, apart from the pumping task described in connection with the prior art equipment, also have another task, namely, keeping the screen plate clean. When the clearance between the vanes 12 and screen plate 13 is made sufficiently small, for example, about 1 mm, the vanes wipe all perforations of the screen plate clear. To be more specific, the vanes 12 create such a heavy turbulence onto the surface of the screen plate so as to prevent the fibers from sticking to the perforations of the screen plate.

Figure 2:
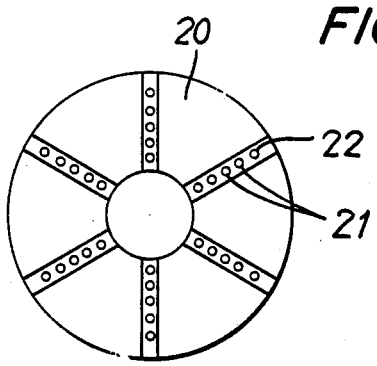
FIG. 2 illustrates a preferred embodiment.
Figure 3:
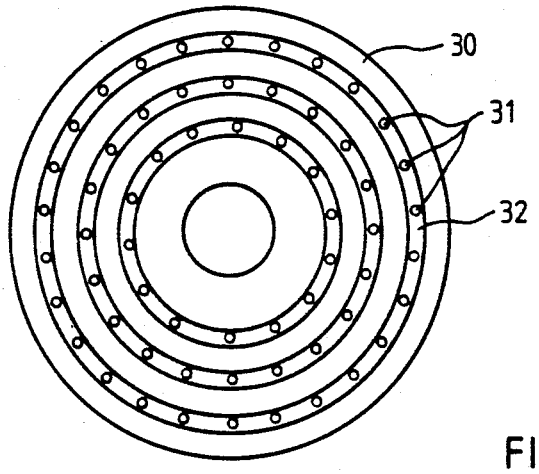
FIG. 3 illustrates a second preferred embodiment.

Said turbulence development and cleaning of the screen plate perforations may be further intensified by screen plate arrangements 20 and 30 in accordance with FIGS. 2 and 3, in which arrangements the perforations 21 and 31 are disposed in the bottom of the grooves 22 and 32 machine into the screen plate. In FIG. 2, the grooves 22 are arranged radially or deviate only slightly from the radial direction. In this case the back vanes 12 of the impeller may preferably be arranged radially or slightly deviate from said direction. The direction of the vanes need not, however, be the same as that of the grooves 22.

In FIG. 3, the perforations 31 of the perforated plate 30 are disposed in the bottom of the grooves 32, just as in the previous embodiment. The grooves 32 are, however, annular, and are therefore easy to make, for example, by turning in a lathe. The grooves may naturally also be spiral-formed. In these cases, a different impeller 6 is necessary. To be more specific, the back vanes 12 of the impeller should deviate from the radial direction because otherwise a desired pressure pulse cannot be generated for clearing the grooves and perforations. Preferably, the back vanes 12 are curved so as to throw the liquid entering the space 11 vigorously outward. Hereby, they also create a pressure pulse adequate to separate the fibers carried with the liquid from the perforations 31 in the grooves 32. In some cases, it is recommended to use a ceramic screen surface which covers the openings machined in the impeller. In such a case, the gas discharge is facilitated through the pores in the surface whereas the solids cannot penetrate them.

In a further embodiment a screen surface similar to a screen plate directly replaces the perforations of the impeller. In that case, it is preferred that there is a great number of perforations in the screen surface and that they are sufficiently small in diameter. A preferred hole size is less that about 0.5 mm in general and in some cases it is more preferred to provide a perforation diameter of about 0.2 mm or even less.

Figure 4:
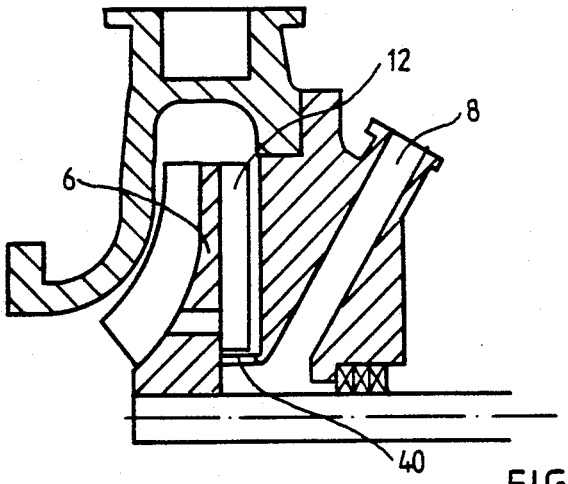
FIG. 4 illustrates a third preferred embodiment.

FIG. 4 illustrates an embodiment with a screen surface 40 being disposed inside the back vanes 12 of the impeller 6. In this case the screen surface comprises a cylindrical surface, which may be also grooved either axially or spirally. Preferably the screen surface is disposed so close to the shaftside edge of the vanes 12 that the vanes 12 keep the screen surface clear from foreign matter. From the space between the screen surface 40 and the shaft the gas is led to the gas discharge duct 8 as in the previous embodiments.

Figure 5:
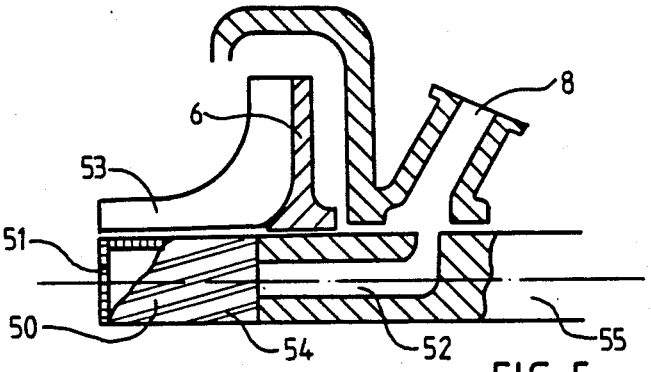
FIG. 5 illustrates a fourth preferred embodiment of the present invention.

FIG. 5 illustrates an embodiment in which the gas discharge is not effected through the impeller 6 but already in front of it. As is known, a gas bubble is formed in the pump in front of the impeller, in the center of the inlet opening. It is generally preferable to remove the gas as soon as possible otherwise the bubble will grow and extend to the impeller thereby preventing the operation of the pump. In the arrangement according to the invention, in front of the impeller, around the shaft there is disposed a member 50, which has preferably been made by bending a screen plate into a cylindrical shape and by closing one end thereof with either a blind plate or a screen plate 51. In the embodiment shown in FIG. 5, the member 50 is attached at its one end to a shaft 55, inside of which a gas duct 52, has been drilled for leading gas to the gas discharge duct 8. There are, of course, also other ways of discharging gas from the member 50. For example, an axial pipe may be provided from the end 51 of the member 50 in the opposite direction, which on the other hand is a more complicated arrangement. Furthermore, FIG. 5 illustrates a fluidizing rotor 53 disposed in the inlet opening 2, the inner edge of the blades of which rotor extends so close to the screen surface of the member 50 that said surface stays clean, especially, if the side of the member 50 opposite the shaft is non-rotatably attached or if member 50 is separately rotatable along with the rest of the apparatus disposed at the front side of the pump. Cleaning may be further assisted by providing the screen surface of the member 50 with axial or spiral-formed grooves 54 the object of which grooves is, together with the blades of the rotor 53, to generate pulses which prevent the solid particles that are carried with the suspension to be pumped from adhering to the perforations of the screen surface.

The perforated plate or screen surfaces may be disposed at several other places as well. For example, vanes 12 on the back side of the impeller may be utilized. A screen surface may be attached to that edge of the vanes which is opposite to the impeller in the radial direction. The screen surface may also be arranged at that edge of the vanes 12 which is nearest to the shaft 5 and the screen surface may be similar in shape to the axial cylinder or a part thereof. In these cases, the screen surface cannot be wiped clear directly by mechanical members, but pulse members arranged in the body construction of the pump have to be used. Two or three of such members are disposed preferably at regular intervals on the body section nearest to the screen surface. These members direct a heavy pressure pulse against the screen surface, which pulse forces the solid substance possibly stuck in the perforations, slots or pores of the screen surface back to the space between the vanes 12, wherefrom the solids are returned by the vanes to the fluid circulation.

As is seen from the above description, the pump according to the present invention avoids the problems of prior art. The basic idea of the device has been to remove gas through separating means such as a perforated surface or a screen surface thereby preventing solid particles entrained in the suspension to be pumped from entering the gas discharge duct or even the space wherefrom gas is taken into said duct.

In all previous devices, perforations with such a wide diameter have been used that solid particles have easily flown through the perforations. Especially, in pumping high-consistency fiber suspensions gradual clogging of the gas discharge ducting has constituted a problem, said clogging being caused by accumulation of pulp fibers into large fiber bundles. For this reason, it has been necessary to use a separate vacuum pump with which the gas has been withdrawn from the gas discharge system. In this case, if the gas discharge ducts have become clogged, it has been possible to clear the ducts by detaching the pipe which connects the vacuum pump to the gas discharge duct and thereafter to clean the duct. Connecting the vacuum pump itself to the main pump has been out of the question because solids being carried with the gas would have damaged the vacuum pump or sooner or later clogged the pump. The result of both cases would have been complicated repair involving the dismantling of the entire pump. In some operational situations it is also possible that the centrifugal pump becomes clogged i.e. filled with highconsistency pulp, in which case the centrifugal pump itself can usually be repaired and again operated by diluting the fiber suspension, but the vacuum pump used for deaeration cannot, even if rinsed, be made to rotate but has to be dismantled. If the vacuum pump is mounted on the shaft of the centrifugal pump, dismantling is rather cumbersome. Thus, a separate vacuum pump with a drive motor is generally used and thus added to the costs of the total construction which has been one of the obstacles to a wider acceptance of a centrifugal pump for use in stock handling. The present invention, however, permits the attachment of the vacuum pump 15 directly to the shaft of the centrifugal pump with no separate drive motor for the vacuum pump because it has been ensured that substantially no solids enter the vacuum pump along with the gas.

Finally, it should be noted that the above description discloses only a few preferred embodiments of the pump arrangement according to the invention, the protective scope of which invention is not limited to the above but is limited only by what is set forth in the accompanying claims. Therefore, all kinds of surfaces provided with holes, slots, pores or other equivalent perforations are within the scope of the present invention. It is also possible to use, similarly to a screen, a surface with bigger perforations to which a thin, felt-like fiber mat is attached, said fiber mat preventing the solids from passing into the gas discharge system. In this case, the thickness of the fiber mat may be adjusted by, for example, a mechanical adjusting element which permits controlling of the thickness of the fiber mat. This may be achieved by mechanical means which permit the adjustment of the distance or clearance between the means and the screen surface whereby a sufficiently strong turbulence i.e. pressure pulses, is caused to loosen the fibers from the fiber mat. Hence, the above term "screen surface" shall not be understood in a narrow sense but in terms of covering a great many arrangements. The basic object of perforated surface or the screen surface being to separate coarser material from a suspension to be pumped, whereby only the solids contained in the suspension as well as the properties thereof determine the type and construction details of the screen surface. Furthermore, the method and apparatus according to the invention is applicable to all pumps and equivalent means in which gas is separated from solids containing liquids.

What is claimed is:

1. An apparatus for pumping a gas containing liquid-solids suspension comprising:

a suspension chamber having a suspension inlet and a suspension outlet;

an impeller mounted for rotation within said suspension chamber for separating said gas from said liquid-solids suspension due to the rotation thereof;

a gas chamber in fluid communication with said suspension chamber; and means non-rotatably disposed between said suspension chamber and said gas chamber for substantially preventing said solids to pass into said gas chamber, said preventing means comprising a surface having a plurality of openings and at least one groove within said surface for causing turbulence on said surface so as to substantially prevent said fibers from obstructing said openings.

2. The pump as claimed in claim 1, wherein said pump is a centrifugal pump.

3. The pump as claimed in claim 2, wherein said impeller has a front side facing said suspension inlet and a back side and an opening for allowing said gas to pass therethrough from said side to said back side.

4. The pump as claimed in claim 3, wherein the impeller has a plurality of openings therein.

5. The apparatus as claimed in claim 2, wherein said surface is a screen surface.

6. The apparatus as claimed in claim 2, wherein said openings have a size sufficiently narrow so as to prevent said solids from entering said openings but sufficiently wide to permit the passage of gas therethrough.

7. The pump as claimed in claim 3, further comprising a back wall and a back vane mounted on said back side of said impeller; and wherein at least a part of said preventing means is located adjacent said vane.

8. The pump as claimed in claim 7, wherein said vane is arranged in close proximity to said preventing means for directing solids and liquid entering said space between said back of said impeller and said back wall outward thereby keeping said preventing means unobstructed by said solids.

9. The pump as claimed in claim 3, further comprising a back wall defining said suspension chamber and extending substantially parallel to said impeller; and wherein said preventing means protrudes from said back wall substantially radially towards said impeller.

10. The pump as claimed in claim 1, wherein at least a part of said openings are disposed within said groove.

11. The pump as claimed in claim 1, further comprising a gas discharge passage in communication with said gas chamber; and a vacuum pump for assisting the passage and removal of said gas through said surface and said gas discharge passage.

12. The pump as claimed in claim 1, further comprising a rotor mounted for rotation within said suspension chamber; and said preventing means being located on said rotor.

13. The pump as claimed in claim 1, further comprising a shaft mounted for rotation within the center of said suspension chamber; and said preventing means being located on said shaft.

14. The apparatus as claimed in claim 1, further comprising a gas discharge passage in communication with said gas chamber; a shaft rotatably mounted within said suspension chamber and operatively connected to said impeller; and a vacuum pump mounted on said shaft for assisting the passage and removal of said gas through said surface and said gas discharge passage.

15. The apparatus as claimed in claim 1, wherein said impeller additionally comprises a fluidizing rotor mounted to said impeller and extending into said pump inlet.

16. An apparatus for pumping a gas containing liquid-solids suspension comprising:

a suspension chamber having a suspension inlet and a suspension outlet;

an impeller mounted for rotation within said suspension chamber; said impeller comprising a screen surface having a plurality of openings therein sufficiently large to allow passage of said gas but sufficiently small to substantially prevent passage of said solids.

17. An apparatus for pumping a gas containing liquid-solids suspension comprising:

a suspension chamber having a suspension inlet and a suspension outlet;

an impeller mounted for rotation within said suspension chamber, said impeller comprising a fluidizing rotor having at least one blade; and means for substantially preventing said solids to pass into said gas chamber, said preventing means comprising a surface having a plurality of openings therein and being disposed within said suspension inlet in front of said impeller inside and closely adjacent said fluidizing rotor so that said rotor blade substantially removes said solids from said prevention means.

18. The apparatus as claimed in claim 17, further comprising a gas discharge passage in communication with said gas chamber; a shaft rotatably mounted within said suspension chamber and operatively connected to said impeller; and a vacuum pump mounted on said shaft within said chamber for assisting the passage and removal of said gas through said surface and said gas discharge passage.

19. An apparatus for pumping a gas containing liquid-solids suspension comprising:

a suspension chamber having a suspension inlet and a suspension outlet;

an impeller mounted for rotation within said suspension chamber, said impeller having a front side facing said suspension inlet and a backside and an opening for allowing said gas to pass therethrough from said front side to said back side and a back vane having a free edge and being mounted to the back of said impeller;

a gas chamber in fluid communication with said suspension chamber; and means attached to said free vane edge for substantially preventing said solids to pass into said gas chamber, said preventing means comprising a screen surface having a plurality of openings therein.

20. The pump as claimed in claim 19, further comprising a shaft rotatably mounted within said suspension chamber; said vane having an edge parallel to said shaft, and said surface being attached to said edge.

21. The pump as claimed in claim 20, further comprising means located in close proximity to said preventing means and cooperating therewith for generating pressure pulses through said perforated surface for preventing clogging of said perforations by said solids.

22. The apparatus as claimed in claim 19, further comprising a gas discharge passage in communication with said gas chamber; a shaft rotatably mounted within said suspension chamber and operatively connected to said impeller; and a vacuum pump mounted on said shaft for assisting the passage and removal of said gas through said surface and said gas discharge passage.

23. An apparatus for pumping a gas containing liquid-solids suspension comprising:

a suspension chamber having a suspension inlet and a suspension outlet;

an impeller and fluidizing rotor attached thereto mounted for rotation within said suspension chamber for separating said gas from said liquid-solids suspension due to the rotation thereof;

a gas chamber in fluid communication with said suspension chamber;

means disposed between said suspension chamber and said gas chamber for substantially preventing said solids to pass into said gas chamber; said preventing means comprising a screen surface having a plurality of openings therein, said openings having a size sufficiently narrow so as to prevent said solids from entering said openings but sufficiently wide to permit the passage of gas therethrough.

24. The apparatus as claimed in claim 23, further comprising a shaft rotatably mounted within said suspension chamber and operatively connected to said impeller; and a vacuum pump mounted on said shaft for assisting the passage and removal of said gas through said surface.

25. A method of separating gas from a gascontaining liquid-solids suspension comprising the steps of:

(a) introducing said liquid-solids suspension into a pump having a suspension inlet and a suspension outlet, and a gas chamber in fluid communication with said suspension chamber;

(b) effecting rotation of said suspension within said suspension chamber with an impeller so that by rotating said impeller said gas is substantially separated from said liquid;

(c) separating said solids from said gas by directing said gas into said gas chamber through a surface having a plurality of openings and at least one groove therein for causing turbulence on said surface so as to substantially prevent said fibers from obstructing said openings; said surface being located between said suspension chamber and said gas chamber;

(d) discharging said gas from said chamber; and (e) discharging said suspension from said suspension outlet.

26. The method as claimed in claim 25, wherein said pump is a centrifugal pump.

27. The method as claimed in claim 26, additionally comprising the steps of:

providing a gas discharge passage in communication with said gas chamber; and applying a vacuum to said discharge passage for assisting the passage and removal of said gas through said surface and said gas discharge passage.

28. The method as claimed in claim 26, wherein step (c) is practiced by directing said gas through a screen surface.

29. The method as claimed in claim 26, wherein step (b) is practiced by effecting rotation of said suspension with an impeller having a front side forcing said suspension inlet and a backside and an opening for allowing said gas to pass therethrough from said front side to said backside.

30. The method as claimed in claim 29, wherein step (b) is practiced by effecting rotation of said suspension with an impeller having a plurality of openings therein.

31. The method as claimed in claim 29, wherein step (b) is practiced by mounting a back vane on said backside of said impeller; and wherein at least part of said surface is positioned adjacent said vane.

32. The method as claimed in claim 31, wherein step (b) is practiced by arranging said vane in close proximity to said surface for directing solids and liquid entering said space between said back of said impeller and said back wall outward thereby keeping said surface unobstructed by said solids.

33. The method as claimed in claim 29, wherein step (a) is practiced by introducing said liquid-solids suspension into a suspension chamber having a back wall defining said suspension chamber and extending substantially parallel to said impeller; and wherein step (c) is practiced by said surface protruding from said back wall substantially radially towards said impeller.

34. The method as claimed in claim 29, wherein step (c) is practiced by separating said solids from said gas by directing said gas through a surface wherein at least a part of said openings are disposed within said groove.

35. The method as claimed in claim 25, wherein step (b) is practiced by mounting a back vane having an edge to the back of said impeller; and wherein step (c) is practiced by attaching said surface to said vane edge opposite said impeller.

36. The method of claim 25, wherein step (c) is practiced by additionally placing a vacuum pump on the same shaft on which the impeller is mounted for assisting the removal of said gas through said surface.

37. A method of separating gas from a gas containing liquid-solids suspension comprising the steps of:

(a) introducing said liquid-solids suspension into a pump having a suspension chamber with a suspension inlet and a suspension outlet;

(b) mounting an impeller for rotation within said suspension chambers;

(c) providing a screen surface including a plurality of openings within said impeller;

(d) separating said solids from said gas by sizing said openings so as to prevent said solids from entering said openings but permitting said gas to pass therethrough;

(e) discharging said gas from said pump separately from said suspension.

38. A method of separating gas from a gas containing liquid-solids suspension comprising the steps of:

(a) introducing said liquid-solids suspension into a pump having a suspension chamber with a suspension inlet and a suspension outlet, and a gas chamber in fluid communication with said suspension chamber;

(b) effecting rotation of said suspension within said suspension chamber with a fluidizing rotor having at least one blade and being mounted for rotation within said suspension chamber so that by rotating said rotor said gas is substantially separated from said liquid;

(c) separating said solids from said gas by directing said gas into said gas chamber through a surface located within said suspension inlet in front of the impeller inside and closely adjacent said rotor so that said rotor blade substantially removes said solids from said surface.

39. The method according to claim 38, wherein step (c) is practiced by additionally placing a vacuum pump on the same shaft on which the impeller is mounted for assisting the removal of said gas through said surface.

40. A method of separating gas from a gas containing liquid-solids suspension comprising the steps of:

(a) introducing said liquid-solids suspension into a pump having a suspension chamber with a suspension inlet and a suspension outlet, and a gas chamber in fluid communication with said suspension chamber;

(b) effecting rotation of said suspension within said suspension chamber so that said gas is substantially separated from said liquid by mounting a back vane having a free edge to the back of said impeller;

(c) separating said solids from said gas by directing said gas into said gas chamber and by attaching a screen surface to said free vane edge so that said chamber is kept essentially free from said solids;

(d) discharging said gas from said gas chamber; and (e) separately discharging said suspension from said suspension outlet.

41. The method as claimed in claim 40, wherein step (b) is practiced by rotatably mounting a shaft within the center of said suspension chamber and attaching a vane to the back of said impeller, said vane having an edge parallel to said shaft; and wherein step (c) is practiced by attaching said surface to said edge.

42. The method as claimed in claim 41, additionally comprising the step of:

generating pressure pulses between said impeller and said surface for preventing clogging of said perforations by said solids.

43. The method according to claim 40, wherein step (c) is practiced by additionally placing a vacuum pump on the same shaft on which the impeller is mounted for assisting the removal of said gas through said surface.

* * * * *